US009936740B2

(12) United States Patent
Howard et al.

(10) Patent No.: US 9,936,740 B2
(45) Date of Patent: Apr. 10, 2018

(54) MATERNITY SUPPORT CLOTHING

(71) Applicants: Erin Howard, Fair Haven, NJ (US); Melissa Peard, Jersey City, NJ (US)

(72) Inventors: Erin Howard, Fair Haven, NJ (US); Melissa Peard, Jersey City, NJ (US)

(73) Assignee: goodbody goodmommy LLC, Jersey City, NJ (US)

( * ) Notice: Subject to any disclaimer, the term of this patent is extended or adjusted under 35 U.S.C. 154(b) by 0 days.

(21) Appl. No.: 15/359,740

(22) Filed: Nov. 23, 2016

(65) Prior Publication Data

US 2017/0143047 A1 May 25, 2017

Related U.S. Application Data

(60) Provisional application No. 62/259,050, filed on Nov. 23, 2015.

(51) Int. Cl.

| | |
|---|---|
| ***A41C 1/10*** | (2006.01) |
| ***A41D 1/20*** | (2006.01) |
| ***A41D 13/05*** | (2006.01) |

(52) U.S. Cl.

CPC ..... *A41C 1/10* (2013.01); *A41D 1/20* (2013.01); *A41D 13/0525* (2013.01); *A41D 2300/32* (2013.01)

(58) Field of Classification Search

CPC .. A41C 1/10; A41C 1/08; A41C 1/003; A41D 1/20; A41D 1/06; A41D 13/0525; A41D 1/062; A41D 1/067; A41D 19/0031; A61F 5/028

USPC ... 450/94–96, 110, 112, 121, 144, 154, 150; 2/227, 228, 237, 44, 231, 92; 602/19

See application file for complete search history.

(56) References Cited

U.S. PATENT DOCUMENTS

| | | | | |
|---|---|---|---|---|
| 4,506,390 A * | 3/1985 | Stern | A41D 1/20 | 2/221 |
| 5,157,790 A * | 10/1992 | Aldridge | A41D 13/0525 | 2/227 |
| 5,205,815 A * | 4/1993 | Saunders | A61F 5/028 | 450/150 |
| 5,399,150 A * | 3/1995 | Saunders | A61F 5/028 | 128/100.1 |
| 5,611,084 A * | 3/1997 | Garry | A41D 13/0525 | 2/102 |
| 6,108,817 A * | 8/2000 | Kostelac | A41D 19/0031 | 2/158 |
| 6,108,819 A * | 8/2000 | DeBaene | A41D 1/067 | 2/227 |
| 6,367,086 B1 * | 4/2002 | Woodard | A41D 1/06 | 2/227 |
| 7,426,754 B2 * | 9/2008 | Chun | A41C 1/003 | 2/46 |

(Continued)

*Primary Examiner* — Gloria Hale

(57) ABSTRACT

A clothing support apparatus integrated within an article of clothing and which provides ample support for expectant mothers while providing them relief from certain discomforts associated with pregnancy. The apparatus includes a set of stretchable wings which extend from a rear or back section of the apparatus to wrap around and under the expectant mother's belly, thereby providing support. Aspects of embodiments of the present invention allow for continued use of the clothing apparatus all through the expectant mother's pregnancy.

20 Claims, 5 Drawing Sheets

(56) References Cited

U.S. PATENT DOCUMENTS

| | | | | |
|---|---|---|---|---|
| 7,814,575 | B2 * | 10/2010 | Hendrickson | A41D 1/20 2/227 |
| 8,291,519 | B2 * | 10/2012 | Arsenault | A61F 5/028 2/227 |
| 8,904,568 | B2 | 12/2014 | Fruscione-Loizides | |
| 2005/0177920 | A1 * | 8/2005 | Wilkinson | A41D 13/0525 2/69 |
| 2006/0010571 | A1 * | 1/2006 | Oakley | A41D 1/062 2/227 |
| 2011/0076921 | A1 * | 3/2011 | Unger | A41C 1/08 450/148 |
| 2013/0095730 | A1 * | 4/2013 | Jensen | A41C 1/003 450/95 |

* cited by examiner

MATERNITY SUPPORT CLOTHING

CROSS-REFERENCE TO RELATED APPLICATIONS

This application claims the benefit of, and is related to Applicant's provisional patent application, U.S. Provisional Patent Application No. 62/259,050 titled "CLOTHING SUPPORT APPARATUS" filed Nov. 23, 2015, which is incorporated herein in its entirety.

FIELD OF THE INVENTION

The present invention relates, in general, to clothing used by expectant mothers during their pregnancy. Specifically, the present invention relates to clothing that provides them with support that is light, matches the expectant mother's contour and alleviates common pregnancy discomforts.

BACKGROUND OF THE INVENTION

Current maternity clothing such as pants, skirts, shorts, dresses, etc. have no built-in support. Expectant mothers who would like extra support during pregnancy have to purchase a separate maternity support belt which oftentimes tends to be heavy, uncomfortable and expensive. These belts are also made from thick, harsh fabrics that do not feel good against the body. While these belts can offer extra support during pregnancy, many women do not purchase them because they tend to be expensive, and are uncomfortable. They also tend to be hot and bulky under clothing. It is nearly impossible for one's clothing to look smooth and seamless when wearing one of these support belts. As such, there is a need for a support apparatus that provides expectant mothers with extra support while pregnant.

SUMMARY OF THE INVENTION

Aspect(s) of embodiment(s) of the present invention contemplate the incorporation of a support feature into maternity clothing that would provide women extra support for their growing bellies during their pregnancies without requiring them to buy and wear a separate, bulky, and expensive belt. The object of aspects of embodiments of the present invention is to combine the functionality of the additional maternity support through an adjustable belt, with a "bottom" or an article of clothing such as a pair of pants. Combining a support apparatus that provides belly support under the pregnant belly into an article of clothing, enables an expectant mother to receive some extra support to help prevent against common pregnancy aliments while not wearing an extra, bulky belt on top of her clothing. In addition, the expectant mother will save money that normally would have been spent on an extra maternity belt. Aspect(s) of embodiment(s) of the present invention provide a much more seamless and hidden maternity support feature for pregnant women clothes, allowing the expectant mother to maintain a sense of style and fashion. The extra support feature, as contemplated, could be adjusted under the wearer's pregnant belly, by wearing the article of clothing and pulling the support as tight as deemed necessary during that stage of the wearer's pregnancy. Because the belt can be pulled as loose or as tight as the wearer wants it to be under her belly, it allows the belt to continue to fit as the woman's belly grows during pregnancy.

An aspect of an embodiment of the present invention contemplates a clothing support apparatus which includes a top section, a middle section, below and connected to the top section, where the middle section includes left and right wings, each wing respectively extending from left and right sides of the middle section. Clothing support apparatus 100 also includes a lower section, below and connected to the middle section, where the lower section separates into two leg holes, to become a bottom such as a pair of pants.

In an aspect of an embodiment of the present invention, the top section may cover an area from the user's/expectant mother's chest to halfway through the user's/expectant mother's belly area. This is to ensure that the garment stays up over the pregnant belly.

In an aspect of an embodiment of the present invention, the left wing of the middle section may extend from a position of the middle section behind the user's left hipbone while the right wing of the middle section may extend from a position of the middle section behind the user's right hipbone.

In an aspect of an embodiment of the present invention, the middle section may cover the lower half of a user's pregnant belly and an area slightly below the user's waist.

In an aspect of an embodiment of the present invention, the lower section may include one or more pockets.

In an aspect of an embodiment of the present invention, the left wing may extend from a point a few inches behind the user's left hipbone and towards the user's back. In other aspects, the wings may extend from different positions.

In an aspect of an embodiment of the present invention, the right wing may extend from a point a few inches measured from the user's right hipbone and towards the user's back. In other aspects, the wings may extend from different positions.

In an aspect of an embodiment of the present invention, the left and right wings each may have a part or one component of an attachment component. In one aspect, the attachment component may be a hook and loop where the left wing may include the loop component of the hook and loop and where the right wing may include the hook component of the hook and loop and vice versa.

In an aspect of an embodiment of the present invention, each of the left and right wings extend at a length sufficient to reach beyond a front midpoint of the user's pregnant belly. When the left and right wing are connected under the wearer's pregnant belly using the attachment components, they will provide support under the pregnant belly.

In an aspect of an embodiment of the present invention, each of the top and middle sections may be made of non-rigid, stretch material which enables the invention to be worn through the mother's pregnancy as the material expands with additional growth of the expectant mother's belly and, in some instances, her body. The top section, which extends over the wearer's pregnant belly, helps to hold the entire garment up, so that it does not fall off the wearer.

Additional aspects, objectives, features and advantages of the present invention will become apparent from the following description of the preferred embodiments with reference to the attached drawings.

DETAILED DESCRIPTION OF THE INVENTION

Figure 1:
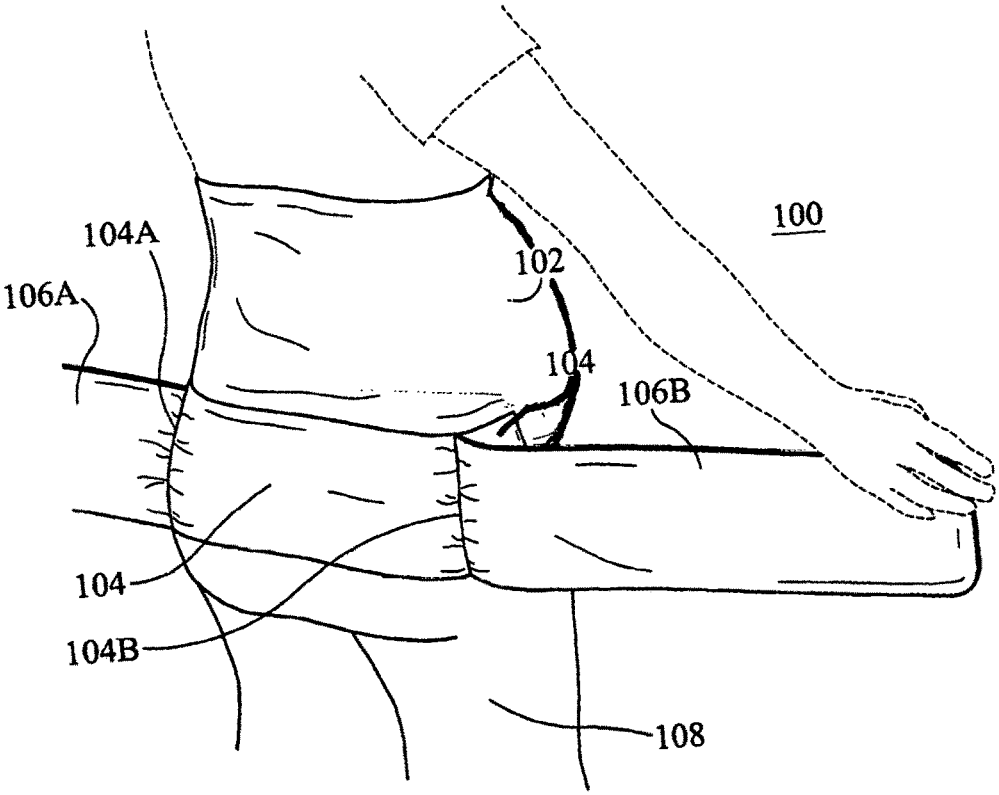
FIG. 1 illustrates a rear view of a clothing support apparatus according to an aspect of an embodiment of the present invention.
Figure 2:
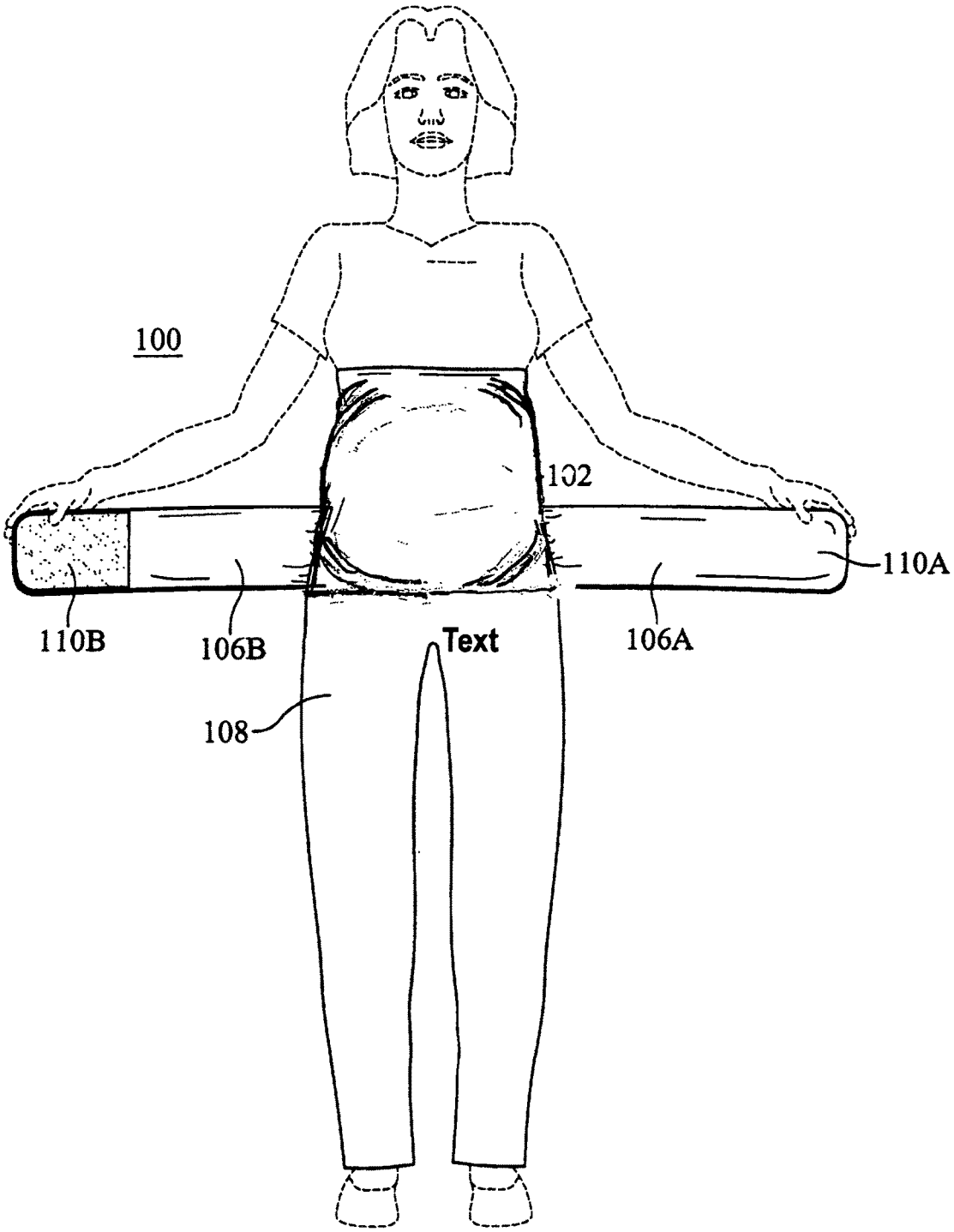
FIG. 2 illustrates rear and side views of a clothing support apparatus according to an aspect of an embodiment of the present invention.

Referring now to FIGS. 1 & 2, rear and side views of a clothing support apparatus 100 is shown according to an aspect of an embodiment of the present invention. Clothing support apparatus 100 may include a top section 102 connected to a middle section 104. In one aspect of an embodiment of the present invention, top section 102 may extend from the expectant mother's chest area down to a halfway point of the mother's pregnant belly.

Extending from two positions along middle section 104 are left wing 106A and right wing 106B. Wings 106A and 106B may, in one aspect of an embodiment of the present invention, be made of stretchable material which enable the wings to be stretched around the expectant mother's waist and under her pregnant belly to provide support. Because the wing material is stretchable, it allows the garment to grow with the pregnant mother. As the pregnant woman's belly grows, the support belt will continue to fit under the belly because it is made from stretchable material. This support feature may be made from comfortable, wicking fabric and soft hook and loop. The wings may be made of stretchy, breathable fabric and have parts of a hook and loop attachment mechanism 110 on both—the hook on one side and the loop on the other. Wings 106A and 106B can be attached together by the hook and loop on the bottom half of the pregnant belly, and adjusted based on how tight the user wants the belt to be, depending on how much support the woman would like under her belly.

Middle section 104 may be connected to lower section 108. Lower section 108 will separate into two leg holes and become a "bottom" such as a pair of pants. Attaching this bottom section—which could be a pair of pants—to the middle section and wings, offers pregnant women the ability to purchase an article of clothing with a belt specifically designed to support a growing pregnant belly built in. This design does not currently exist.

The different sections of clothing support apparatus 100 may be connected as discussed above by way of stitching or other ways of attaching clothing sections together as known in the art.

In one aspect of an embodiment of the present invention, wings 106A and 106B of clothing support apparatus 100 may each be a piece of fabric that is sewn, at or beginning at a connection point, (104A for left wing 106A or 104B for right wing 106B) with a seam on both sides of the rear of the article of clothing. In an aspect of an embodiment of the present invention, when the article of clothing, as contemplated, is in use, either or both connection points 104A and 104B may be located or start approximately from a position or a certain distance measured from the expectant mother's hipbone towards her back. In one aspect of an embodiment of the present invention, this distance may be 4 inches toward the back from either hipbone. In another aspect of an embodiment of the present invention, connection points 104A and 104B may be located or may start at a point further back instead of at the expectant mother's hipbones. This configuration provides the extra support the expectant mother needs, while also allowing the article of clothing to reach its desired functionality of offering support.

Figure 3:
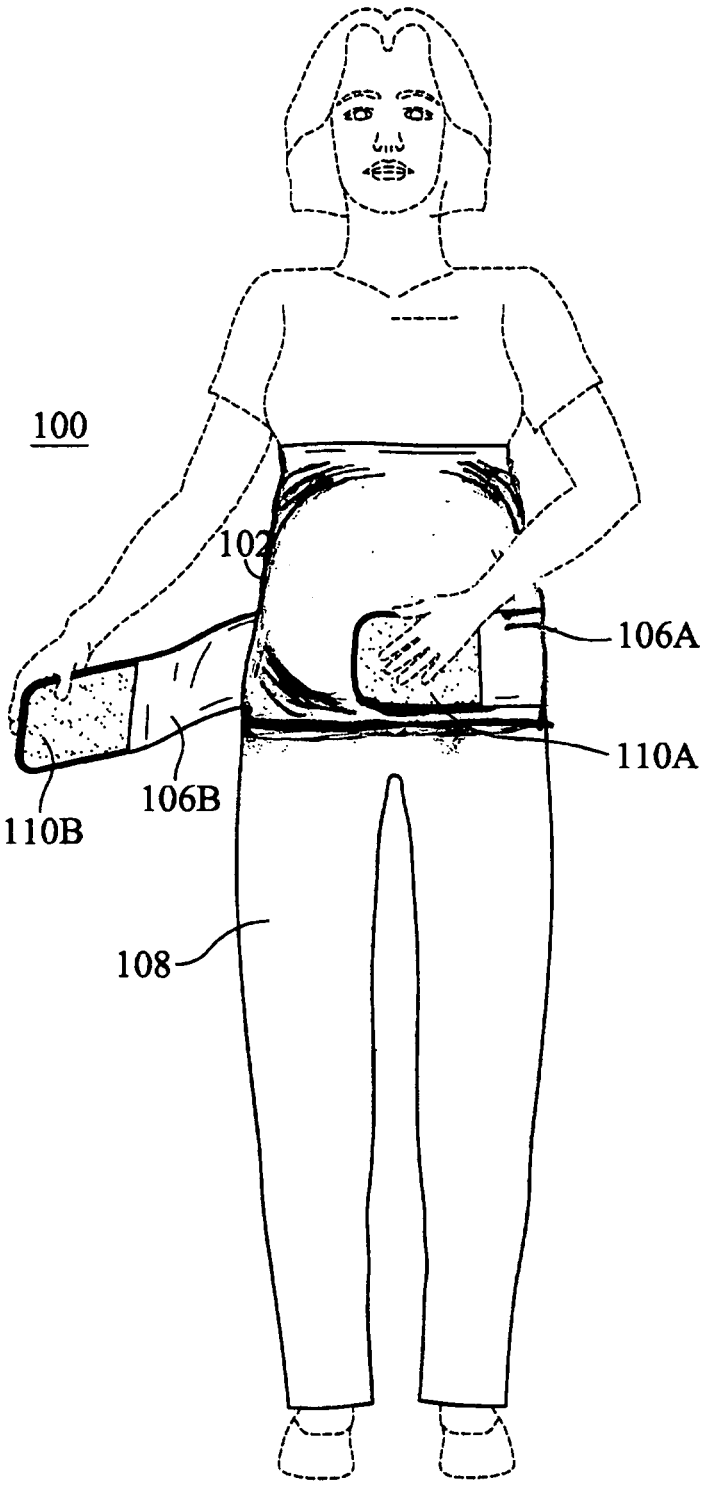
FIG. 3 illustrates a front view of a clothing support apparatus according to an aspect of an embodiment of the present invention.
Figure 4:
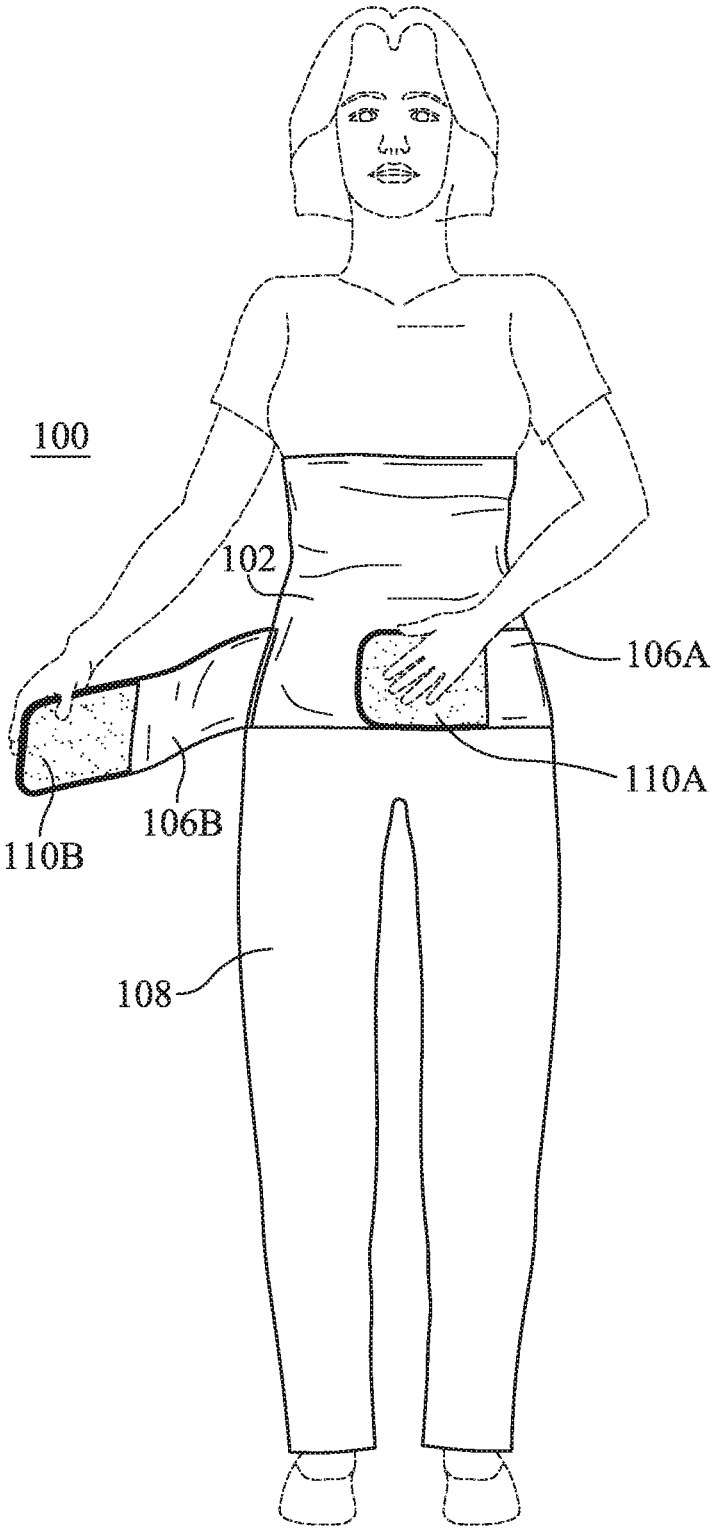
FIG. 4 illustrates a front view of a clothing support apparatus showing use of support wings according to an aspect of an embodiment of the present invention.
Figure 5:
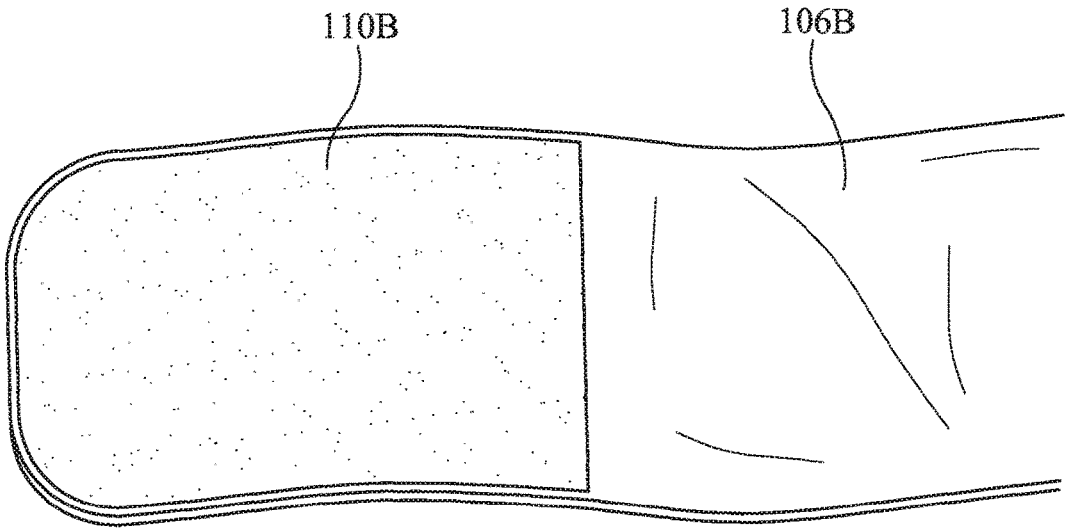
FIG. 5 illustrates a detailed view of part of an attachment mechanism as positioned on one of the wings of a clothing support apparatus according to an aspect of an embodiment of the present invention.

Referring now to FIGS. 3-5, different front views of the clothing support apparatus 100 and its attachment mechanism 110A & 110B are shown according to aspects of embodiments of the present invention. As shown and discussed above, clothing support apparatus 100 may have two "wings" or "connection sections" also known as left wing 106A and right wing 106B which extend (respectively beginning from connection points 104A and 104B, according to one aspect) from either side of middle section 104 above the article of clothing 108. Connection sections 106A and 106B may together have an attachment mechanism 110 (i.e. components 110A and 110B together) for connecting wings 106A and 106B together to provide the support function as contemplated by an aspect of an embodiment of the present invention. In one aspect of an embodiment of the present invention the hook will be on one wing and the loop on the other wing so that they close under the belly.

In another aspect of an embodiment of the present invention, attachment mechanism 110 may be hook and loop. In another aspect of an embodiment of the present invention, each of wings 106A and 106B may have a length of 8-10 inches of hook and loop on both sides in the front, with the loop on one side, and the corresponding hook on the other side. This feature of the support apparatus enables the wearer to pull the support apparatus as tight as she may like under the pregnant belly and fasten it with the hook and loop attachment mechanism to get extra support and to ensure that clothing support apparatus 100 fits her unique pregnant body. In one aspect of an embodiment of the present invention, wings 106A and 106B may be 4 inches wide. Clothing support apparatus 100 may also be configured to be thick enough to both stay fastened in place and provide support under the pregnant belly.

In one aspect of an embodiment of the present invention, wing 106A comprises of a part of attachment mechanism 110, part 110A at its end while wing 106B also comprises of a part of attachment mechanism 110, part 110B at its end. Both 110A and 110B may be complimentary parts of attachment mechanism 110 which when brought in contact with one another, secure wings 106A and 106B together. In one aspect, where attachment mechanism 110 is a hook and loop, part 110A may be the hook (not shown) while part 110B may be the loop.

Clothing support apparatus 100 is a unique piece which is different from what is currently on the market. In one aspect of an embodiment of the present invention, wings 106A and 106B may be adjustable as a result of their stretchy material and closure. When pulled under the belly, wings 106A and 106B can offer extra support to the expectant mother to help protect against many common discomforts of pregnancy. The stretchy material allows the wearer to adjust the support during her pregnancy, and also ensures that the belt will continue to fit as the wearer's pregnancy progresses and her belly grows.

Because clothing support apparatus 100 is part of the article of clothing by combining the belt with the bottom portion, it is more seamless for the wearer rather than wearing an extra maternity support belt. It is not easily seen under clothing, and it is not bulky and uncomfortable like existing support belts. Clothing support apparatus 100 works in conjunction with the article of clothing to offer more stylish, extra support for the wearer.

Clothing support apparatus 100 distinguishes itself as an article of outer clothing in that it is not an undergarment or stand-alone support belt. Clothing support apparatus 100 presents a built-in adjustable supportive belt which includes left wing 106A and right wing 106B on either side of middle section 104 of apparatus 100. Wings 106A and 106B may, in one aspect of an embodiment of the present invention, be attached (by sewing) to the back of the garment and can be wrapped around to the front of the garment.

The support aspects of clothing support apparatus 100 is truly integrated into the clothing by wings 106A and 106B which are sewn into section 104. Section 104 is connected to lower section 108 (e.t. a pair of pants.) This eliminates the need for a bulky additional support belt, if the user needs light to medium support belly support during pregnancy. When wings 106A and 106B are attached together by attachment mechanism 110A and 110B in the front of the garment, it provides light-to-medium support that can be adjusted to fit comfortably through the entire duration of pregnancy, because of the elastic fabric of wings 106A and 106B and attachment mechanism 110A and 110B closure of the wings which allows the expectant mother to adjust how tightly the wings close around her belly.

The invention has been described in detail with particular reference to certain preferred embodiments thereof, but it will be understood that variations and modifications can be effected within the spirit and scope of the invention.

What is claimed is:

1. A lower torso support garment having a built-in adjustable belly support belt for supporting a protruding pregnant belly of a pregnant wearer comprising:

a lower torso covering support garment constructed of a stretchable support material configured to support the wearer's lower torso and legs;

said lower torso covering support garment including a top section, a middle section and a lower section;

said top section including a tubular stretchable fabric section that begins at an open tubular upper end located from just under the wearer's chest that then extends downwardly to a point halfway down on said wearer's protruding belly at a lower end of said top section;

said top section stretches over said wearer's pregnant belly to said halfway point on said wearer's protruding, pregnant belly to a lower end of said top section to then attach to a top of said middle section;

said middle section including a tubular stretchable fabric section has a middle section top end that extends from said halfway point on said wearer's belly at said top section lower end and is attached to said top section lower end:

said middle section is a tubular stretchable fabric portion that continues downwardly from said middle section top end at said belly halfway point over said pregnant belly towards the wearer's crotch and ends in a middle section lower end at said crotch;

said lower section has a first end at said wearer's crotch that is attached to a lower end of said middle section and extends downwardly and separates into two leg sections that are configured to cover a wearer's legs;

said middle section further includes a back portion in a back half of said middle section tubular portion;

said middle section comprises left and right stretchable, elastic support belt wings;

each of said left and right stretchable, elastic support belt wings are attached at a connection seam located at a point located from between the wearer's hip bone and a middle of the user's back;

said right support belt wing has a first end attached to said middle section stretchable material at a right connection seam that is located at a location point located between the wearer's hip bone and a middle of the wearer's back;

said left and right belt support wing each having a second end each with complementary hook and loop fastener components that attach said left and right support belt wing second end portions together in front of and under said wearer's protruding belly at a point under said wearer's pregnant protruding belly to wrap under and provide support to said wearer's protruding pregnant belly;

said left and right stretchable support belt wings are configured of said stretchable, elastic support material of a length configured to extend and connect together with said hook and loop fastener material in an adjustable fashion to thereby cradle and support said pregnant wearer's protruding pregnant belly therein.

2. A lower torso support garment as claimed in claim 1 wherein said left and right support belt wings are constructed of stretchable, elastic fabric and are configured of a length structured to extend and connect at a point beyond a front midpoint of the pregnant wearer's protruding pregnant belly.

3. A lower torso support garment as claimed in claim 1 wherein the said first end of said left support belt wing and said first end of said right support belt wing each extend from a connection seam that is located at a point approximately 4 inches from behind the wearer's respective left and right hip bone to thereby provide a desired amount of support to said wearer's protruding pregnant belly when said left and right support belt wings are connected under said pregnant wearer's protruding belly.

4. A lower torso support garment as claimed in claim 1 wherein said lower section of said torso garment includes one or more pockets therein.

5. A lower torso support garment as claimed in claim 1 wherein each of said stretchable support belt wings have a width and said width is 4 inches wide.

6. A lower torso support garment as claimed in claim 2 wherein each of said left and right stretchable support belt wings have a connection seam located on said lower torso at a point that is approximately 4 inches from said wearer's hip bone between said hip bone and a middle of said wearer's back.

7. A lower torso support garment as claimed in claim 2 wherein said lower section of said torso garment includes one or more pockets therein.

8. A lower torso support garment as claimed in claim 3 wherein said lower section of said torso garment includes one or more pockets therein.

9. A lower torso support garment as claimed in claim 5 wherein said lower section of said torso garment includes one or more pockets therein.

10. A lower torso support garment as claimed in claim 3 wherein said lower section of said torso garment includes one or more pockets therein.

11. A lower torso support garment as claimed in claim 6 wherein said lower section of said torso garment includes one or more pockets therein.

12. A method of supporting a pregnant belly of a wearer comprising:

providing a lower torso support garment having a built-in adjustable belly support belt for supporting a protruding pregnant belly of a pregnant wearer;

said lower torso support garment including a lower torso covering support garment constructed of a stretchable support material configured to support the wearer's lower torso and legs;

said lower torso covering support garment including a top section, a middle section and a lower section;

said top section including a tubular and stretchable fabric section that begins at an open tubular upper end located from just under the wearer's chest that then extends downwardly to a point halfway down on said wearer's protruding belly at a lower end of said top section;

said top section stretches over said wearer's pregnant belly to said halfway point on said wearer's protruding, pregnant belly;

a lower end of said top section to then attach to the top of said middle section;

said middle section including a tubular and stretchable fabric section that has a middle section top end that extends from said halfway point on said wearer's belly and is attached to said top section lower end:

said middle section is a tubular stretchable fabric portion that continues downwardly from said middle section top end at said belly halfway point over said pregnant belly towards the wearer's crotch and ends in a middle section lower end at said crotch;

said lower section has a first end at said wearer's crotch that is attached to a lower end of said middle section and extends downwardly and separates into two leg sections that are configured to cover legs of said wearer;

said middle section further includes a back portion in a back half of said middle section tubular portion;

said middle section comprises left and right stretchable, elastic support belt wings;

each of said left and right stretchable elastic support belt wings are attached at a connection seam located at a point between the wearer's hip bone and a middle of the user's back;

said right support belt wing has a first end attached to said middle section stretchable material at a right connection seam that is located at a location point located between the wearer's hip bone and a middle of the wearer's back;

said left and right support belt wings each having a second end each with complementary hook and loop fastener components that attach said left and right support belt wing second end portions together on front of and under said wearer's protruding belly to wrap under and provide support to said wearer's protruding pregnant belly;

said left and right stretchable support belt wings are configured of said stretchable, elastic support material of a length configured to extend and connect together with said hook and loop fastener material in an adjustable fashion to thereby cradle and support said pregnant wearer's protruding pregnant belly therein;

pulling said lower torso support garment on the lower torso of said pregnant wearer and pulling said lower torso garment top section first end up to and just under said chest area of said wearer wherein said crotch portion is located at said wearer's crotch and said leg portions cover said wearer's legs;

aligning said first end of said left adjustable support belt wing at a point between said wearer's left hip bone and said middle of the wearer's back;

aligning said first end of said right adjustable belt support wing at a point between said wearer's right hip bone and said middle of the wearer's back;

pulling said second end of said left adjustable support belt wing towards the right under said pregnant wearer's protruding pregnant belly to the center of said wearer's pregnant belly thereby stretching said stretchable, elastic support belt taught to the desired front connection point under said wearer's belly for connection to said right adjustable belt;

pulling said second end of said right adjustable support belt wing towards the left under said pregnant wearer's protruding pregnant belly to a center of said wearer's pregnant belly thereby stretching said stretchable, elastic support belt taught to the desired front connection point under said wearer's belly for connection to said left adjustable belt support wing;

attaching said second end hook and loop complementary fastener components on said belt wing second ends together to secure said left support belt wing to said right support belt wing to thereby support and cradle the pregnant wearer's protruding pregnant belly within the stretchable elastic support belt.

13. A method of constructing a lower torso support garment having a built-in adjustable belly support belt for supporting a protruding pregnant belly of a pregnant wearer comprising:

forming a lower torso covering support garment constructed of a stretchable support material including a top section, a middle section and a lower section configured to support the wearer's lower torso and legs;

forming said top section configured to include a tubular stretchable fabric section that begins at an open tubular upper end configured to be located from just under the wearer's chest that then extends downwardly to a point halfway down on said wearer's protruding belly at a lower end of said top section;

forming said top section configured to stretch over said wearer's pregnant belly to said halfway point on said wearer's protruding, pregnant belly to a lower end of said top section to then attach to a top of said middle section;

forming said middle section including a tubular and stretchable fabric section that has a middle section top end configured to extend from said halfway point on said wearer's belly at said top section lower end and is attached to said top section lower end:

forming said middle section including a tubular stretchable fabric portion that is configured to continue downwardly from said middle section top end at said belly halfway point over said pregnant belly towards the wearer's crotch and ends in a middle section lower end at said crotch;

forming said lower section configured to have a first end at said wearer's crotch that is attached to a lower end of said middle section and extends downwardly and separates into two leg sections that are configured to cover a wearer's legs;

said middle section is configured to further include a back portion in a back half of said middle section tubular portion;

forming said middle section to further comprise left and right stretchable, elastic support belt wings;

each of said left and right stretchable, elastic support belt wings are then attached at a connection seam located at a location point between the wearer's hip bone and a middle of the user's back;

said right support belt wing is configured to include a first end attached to said middle section stretchable material at a right connection seam that is located at a location point located between the wearer's hip bone and a middle of the wearer's back;

said left and right belt support wings are each configured as having a second end each with complementary hook and loop fastener components that attach said left and right support belt wing second end portions together in front of and under said wearer's protruding belly at a point under said wearer's pregnant protruding belly to wrap under and provide support to said wearer's protruding pregnant belly;

said left and right stretchable support belt wings are configured of said stretchable, elastic support material of a length configured to extend and connect together with said hook and loop fastener material in an adjustable fashion to thereby cradle and support said pregnant wearer's protruding pregnant belly therein.

14. A method of constructing a lower torso support garment having a built-in adjustable belly support belt for supporting a protruding pregnant belly of a pregnant wearer as claimed in claim 13 and further comprising:

forming said lower torso covering support garment constructed of a stretchable support material as further including said lower section of said torso garment with one or more pockets therein.

15. A method of constructing a lower torso support garment having a built-in adjustable belly support belt for supporting a protruding pregnant belly of a pregnant wearer as claimed in claim 13 and further comprising:

forming said lower torso covering support garment constructed of a stretchable support material as further including wherein said left and right support belt wings are constructed of stretchable, elastic fabric and are configured of a length structured to extend and connect at a point beyond a front midpoint of the pregnant wearer's protruding pregnant belly.

16. A method of constructing a lower torso support garment having a built-in adjustable belly support belt for supporting a protruding pregnant belly of a pregnant wearer as claimed in claim 13 and further comprising:

forming said lower torso covering support garment constructed of a stretchable support material wherein said stretchable support belt wings have a width and said width is 4 inches wide.

17. A method of constructing a lower torso support garment having a built-in adjustable belly support belt for supporting a protruding pregnant belly of a pregnant wearer as claimed in claim 13 and further comprising:

forming said lower torso covering support garment constructed of a stretchable support material wherein each of said stretchable support belt wings have a connection seam located on said lower torso stretchable support garment back that is located at a point that is 4 inches from said wearer's hip bone between said hip bone and a middle of said wearer's back.

18. A method of constructing a lower torso support garment having a built-in adjustable belly support belt for supporting a protruding pregnant belly of a pregnant wearer as claimed in claim 14 and further comprising:

forming said lower torso covering support garment constructed of a stretchable support material wherein each of said stretchable support belt wings have a connection seam located on said lower torso stretchable support garment back that is located at a point that is 4 inches from said wearer's hip bone between said hip bone and a middle of said wearer's back.

19. A method of constructing a lower torso support garment having a built-in adjustable belly support belt for supporting a protruding pregnant belly of a pregnant wearer as claimed in claim 16 and further comprising:

forming said lower torso covering support garment constructed of a stretchable support material wherein each of said stretchable support belt wings have a connection seam located on said lower torso stretchable support garment back that is located at a point that is 4 inches from said wearer's hip bone between said hip bone and the middle of said wearer's back.

20. A method of constructing a lower torso support garment having a built-in adjustable belly support belt for supporting a protruding pregnant belly of a pregnant wearer as claimed in claim 13 and further comprising:

forming said lower torso covering support garment constructed of a stretchable support material wherein said stretchable support belt wings have a width and said width is 4 inches wide and wherein said lower section of said torso garment has one or more pockets therein and wherein each of said stretchable support belt wings have a connection seam located on said lower torso stretchable support garment back that is located at a point that is 4 inches from said wearer's hip bone between said hip bone and a middle of said wearer's back.

* * * * *